US005119775A

United States Patent [19]

Kokubo et al.

[11] Patent Number: 5,119,775

[45] Date of Patent: Jun. 9, 1992

[54] METHOD FOR SUPPLYING FUEL TO INTERNAL COMBUSTION ENGINE

[75] Inventors: Kakuro Kokubo, Ohi; Nobuo Iwai, Tsukuba, both of Japan

[73] Assignee: Tonen Corporation and Japan Automobile Research Institute & Incorporation, Tokyo, Japan

[21] Appl. No.: 720,328

[22] Filed: Jun. 25, 1991

[30] Foreign Application Priority Data

Jun. 26, 1990 [JP] Japan ..... 2-168022

[51] Int. Cl.[5] ..... F02N 17/00

[52] U.S. Cl. ..... 123/179.16; 123/179.7; 123/179.21

[58] Field of Search ..... 123/179.16, 179.17, 123/179.21, 180 R, 180 A, 180 E, 3, 536, 537

[56] References Cited

U.S. PATENT DOCUMENTS 4,488,517 12/1984 Yoon ..... 123/3

4,762,093 8/1988 McCabe ert al. ..... 123/3

5,000,152 3/1999 1McCauley ..... 123/536

*Primary Examiner*—Noah P. Kamen

*Attorney, Agent, or Firm*—Armstrong & Kubovcik

[57] ABSTRACT

In an engine using fuel of low startability, there are provided an ultrasonic atomizer and a fuel injection valve arranged on a suction pipe of the engine, and a catalyzer unit mounted between said ultrasonic atomizer and a fuel injection valve. When the engine is started, the fuel atomized by the ultrasonic atomizer is supplied to the catalyzer unit to generate an intermediate product of high volatility. After the engine has been started, fuel is supplied through the fuel injection valve. When a fuel is passed through the catalyzer unit such as methanol fuel, aldehyde is generated by a decomposition reaction, reforming reaction, partial oxidation reaction, etc., or dimethylether is generated by a dehydrating condensation reaction. By supplying this intermediate product of high volatility to the engine, the startability of the engine at low temperatures is improved.

3 Claims, 2 Drawing Sheets

METHOD FOR SUPPLYING FUEL TO INTERNAL COMBUSTION ENGINE

BACKGROUND OF THE INVENTION

The present invention relates to a method for supplying fuel to an internal combustion engine which uses fuel of low startability such as kerosene, alcohol or a mixture fuel of alcohol and gasoline.

In the past, to improve the startability of an internal combustion engine, a choke valve or a starting promoting mechanism was provided for an engine type using a carburetor-type fuel supply system. In a spark ignition engine such as a gasoline engine, an injection valve is electronically controlled in the system using a fuel injection valve to increase the supply of fuel during starting.

Although the startability can be maintained at a normal temperature by the above measures, much more time is required when starting an engine at a low external temperature or HC emission is augmented due to the increase of fuel.

Further, when using a fuel of low volatility other than gasoline, it is difficult to start the engine at a normal temperature or a low temperature, even when the above conventional methods are adopted. In the case of fuel containing methanol at 100%, the lowest possible starting temperature is 5° C. For this reason, the startability of an engine running on methanol is improved by mixing gasoline with the methanol to an approximately 15% concentration when starting the engine. However, the lowest possible starting temperature with such a mixture is still limited to −10° C. to −15° C., and thus remains a problem for engine startability in a low temperature environment.

SUMMARY OF THE INVENTION

To solve the above problems, attempts have been made to adopt ultrasonic atomizers instead of fuel injection valves, whereby the atomizers atomize the fuel by ultrasonic vibration thereby improving ignition by promoting fuel evaporation. Atomizing improves the startability to some extent, but, in the case of 100% methanol fuel, the lowest possible starting temperature is limited to about 0°C.

The reason for this lower temperature limit is as follows: The mounting procedure of an ultrasonic atomizer on a suction pipe and the movement of the atomized spray in the combustion chamber are inadequate since fuel attaches on the inner wall of the pipe. Fuel is not vaporized sufficiently during compression and does not ignite because of the low volatility of the fuel. Even when fuel flows into the combustion chamber as a spray, the fuel is not sufficiently vaporized and does not ignite because the latent heat of vaporization is high in the case of an alcohol fuel, or because the boiling point is too high in the case of kerosene.

An object of the present invention is to solve the above-noted problems by enabling an engine using fuel of low startability to start at low temperatures, to shorten the starting time of the engine, and to reduce HC emissions.

Still other objects and advantages of the invention will in part be obvious and will in part be apparent from the specification.

To achieve the above objects, the method for supplying fuel to an internal combustion engine according to the present invention is characterized in that, in an engine using fuel of low startability, there are provided an ultrasonic atomizer and a fuel injection valve furnished on a suction pipe of the engine, and a catalyzer unit mounted between said ultrasonic atomizer and said fuel injection valve, whereby the fuel atomizer by said ultrasonic atomizer is supplied to said catalyzer unit to generate an intermediate product of high volatility during engine starting, and fuel is supplied from said fuel injection valve once the engine has been started.

According to the present invention, fuel is supplied from a fuel supply valve to an ultrasonic vibration member during engine starting, and the fuel is atomized to fine liquid particles by the ultrasonic atomizer. When using methanol fuel, for example, when the atomized particles are passed through the catalyzer unit, aldehyde is generated by a decomposition reaction, reforming reaction, partial oxidation reaction, etc. or dimethylether is generated by a dehydrating condensation reaction. Thus, by supplying the intermediate product of high volatility to the engine, the startability of the engine at a low temperature can be improved.

BRIEF DESCRIPTION OF THE DRAWINGS

This invention may be better understood and its numerous objects and advantages will become apparent to those skilled in the art by reference to the accompanying drawings, wherein.

DESCRIPTION OF THE PREFERRED EMBODIMENTS

In the present invention, it is most effective to use a fuel of low startability such as kerosene, alcohol, or a mixture of alcohol and gasoline.

Figure 1:
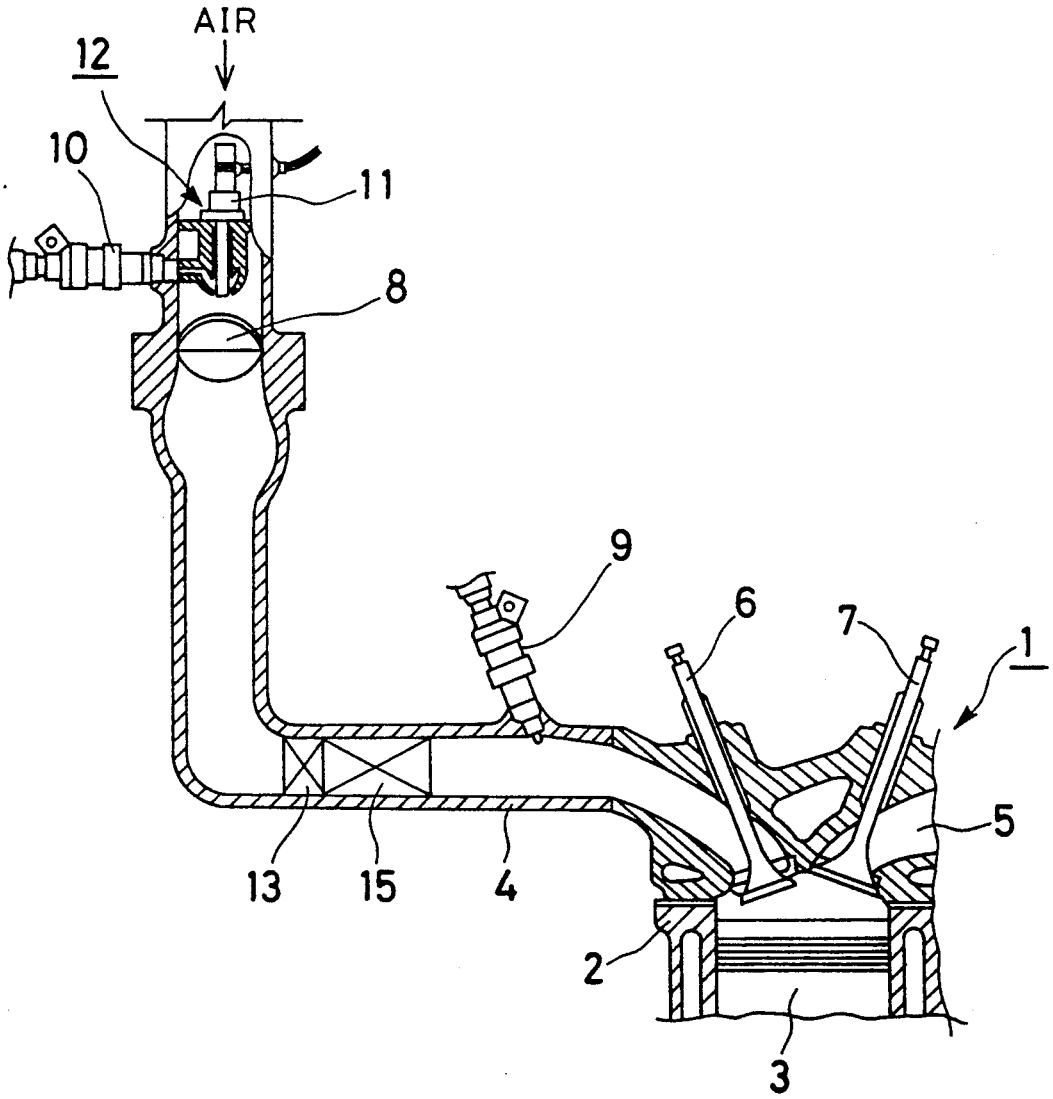
FIG. 1 is a cross-sectional view showing an embodiment of the system for supplying fuel to an internal combustion engine according to the present invention.

In FIG. 1, numeral 1 represents a spark ignition engine, which comprises a cylinder 2, a piston 3, a suction pipe 4, and an exhaust pipe 5, a suction valve 6, and a exhaust valve 7. On the suction pipe 4, a fuel injection valve 9 and a throttle valve 8 are mounted. In addition, an ultrasonic atomizer 12 comprising a fuel supply valve 10 and an ultrasonic vibration member 11 is provided upstream of the throttle valve 8.

On one end of the ultrasonic vibration member 11, an atomizing plane is formed, and an electro-acoustic conversion element is furnished on the other end. The atomizing plane may have a commonly known shape such as horn-type shape, a circular-type shape, a bat-type shape, etc.

A heater 13 and a catalyzer unit 15 are provided between the throttle valve 8 and the fuel injection valve 9. The catalyzer unit 15 comprises a carrier, which supports a catalytic layer reacting at a low temperature or at normal temperature. For example, in the case of methanol, aldehyde is generated by a decomposition reaction, reforming reaction, partial oxidation reaction, etc. or dimethylether is generated by a dehydrating condensation reaction. In short, the intermediate product of high volatility is generated, and the vaporization of methanol by reaction heat is thereby promoted.

The activity of the catalyzer unit 15 varies according to the type and content of the metals therein. For those metals having a good low-temperature activity, a catalytic layer is used alone, while a heater 13 is installed immediately upstream for those metals reacting at normal temperature. In order to prevent heating due to excessive reaction in the catalytic layer, or to obtain the intermediate product required, the quantity of fuel or air at the inlet of the catalytic layer may be controlled within a certain range.

Following is a description of the operation of the present invention with the above arrangement. When the engine is started, fuel is supplied from the fuel supply valve 10 to the ultrasonic vibration member 11, so that the fuel is atomized to fine liquid particles by ultrasonic atomizer 12. When these fine liquid particles are passed through the catalyzer unit 15, effective reaction occurs with the catalytic layer. For example, in the case of methanol fuel, aldehyde is generated by a decomposition reaction, reforming reaction, partial oxidation reaction, etc., or dimethylether is generated by dehydrating condensation reaction. By supplying the intermediate product of high volatility to be ignited, the startability of the engine at low temperatures is improved. After the engine has been started, the fuel supply is changed over to the supply of fuel through fuel injection valve 9.

By the present invention, the lowest possible starting temperature can be reduced to −15° C. in case of 100% methanol. If use is made of a mixture of 85% methanol and 15% gasoline, the lowest possible starting temperature can be desirably decreased to −25° C. or lower.

Figure 2:
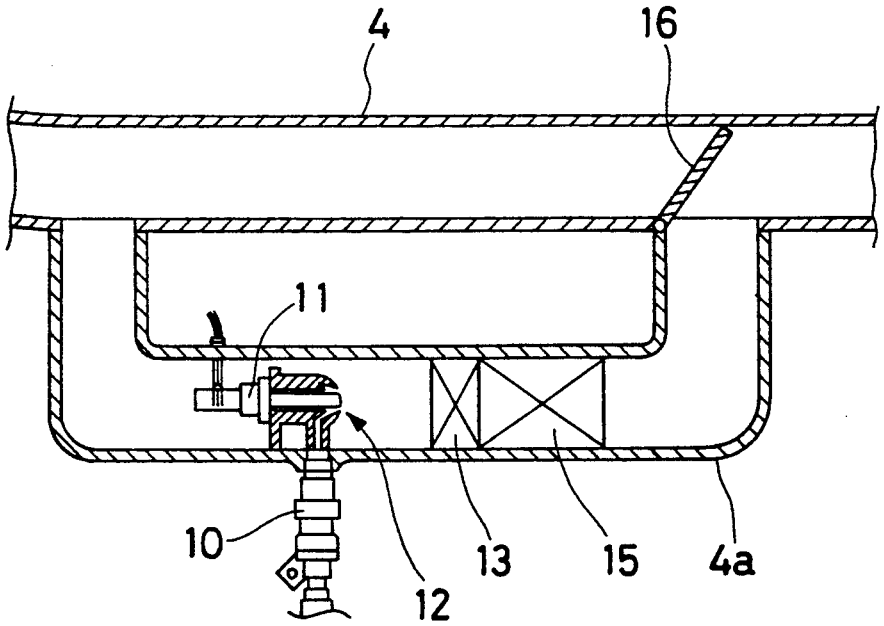
FIG. 2 is a partial cross-sectional view showing another embodiment of the invention.

Next, description is given on another embodiment of the invention in connection with FIG. 2. In this embodiment, a bypass pipe 4*a* changeable by a changeover valve 16 is provided on the suction pipe 4. An ultrasonic atomizer 12, a heater 13 and a catalyzer unit 15 are furnished in the bypass pipe 4*a*.

In this embodiment, the air is passed through the bypass pipe 4*a* by the changeover valve 16, and the intermediate product of fuel is generated by ultrasonic atomizer 12 and a catalyzer unit 15. After the engine has been started, the air is supplied into the suction pipe 4 by changing the changeover valve 16. This contributes to the improved durability of the catalyzer unit 15.

As described above, it is possible according to the present invention to start an engine using fuel of low startability at low temperature, to shorten the starting time, and to reduce HC emission because the fuel atomized by ultrasonic atomizer is supplied to the catalyzer unit during engine starting to generate an intermediate product of high volatility.

The present invention is not limited to the above embodiments, and various changes and modifications will be apparent to those skilled in the art. For example, a set of the above ultrasonic atomizer 12 and a catalyzer unit 15 may be provided on the assembled section of the suction pipe, or they may be mounted on the suction pipe of each cylinder. In addition, gasoline may be used as fuel, and the invention is not limited to spark ignition engine, but it may be applied for diesel engine. Other modifications are equally apparent to those skilled in the art and need not be described in further detail.

What is claimed is:

1. A method for supplying fuel to an internal combustion engine using fuel of low startability, wherein an ultrasonic atomizer and a fuel injection valve are provided on a suction pipe of the engine with a catalyzer unit mounted therebetween, the method comprising the steps of:

atomizing the fuel with said ultrasonic atomizer;

supplying said atomized fuel to said catalyzer unit during engine starting to generate a volatile intermediate product; and supplying the fuel through said fuel injection valve once the engine has been started.

2. A method for supplying fuel to an internal combustion engine according to claim 1, wherein a bypass pipe changeable by a changeover valve is furnished on said suction pipe, and said ultrasonic atomizer and catalyzer unit are furnished in said bypass pipe.

3. A method for supplying fuel to an internal combustion engine according to claim 1 or 2, wherein a heater is provided upstream of said catalyzer unit.

* * * * *